US006543161B2

(12) United States Patent
Chin

(10) Patent No.: US 6,543,161 B2
(45) Date of Patent: Apr. 8, 2003

(54) IDENTIFICATION TAG OF A SUITCASE

(76) Inventor: Wei-Chih Chin, #113, Lane 60, Go Gong Jiaw St., Tail City, Tiachung Hsien (TW)

( * ) Notice: Subject to any disclaimer, the term of this patent is extended or adjusted under 35 U.S.C. 154(b) by 0 days.

(21) Appl. No.: 09/922,024

(22) Filed: Aug. 3, 2001

(65) Prior Publication Data

US 2002/0092213 A1 Jul. 18, 2002

Related U.S. Application Data

(63) Continuation-in-part of application No. 09/465,312, filed on Dec. 17, 1999, now abandoned.

(51) Int. Cl.[7] ..... G09F 3/20
(52) U.S. Cl. ..... 40/6; 40/299.01
(58) Field of Search ..... 40/6, 299.01, 330, 40/634, 649, 635, 654.01, 765, 770, 700

(56) References Cited

U.S. PATENT DOCUMENTS 1,452,250 A * 4/1923 Moore et al. ..... 40/299.01
2,195,042 A * 3/1940 Wishinsky ..... 40/330
2,655,747 A * 10/1953 Duskin ..... 40/6
2,793,451 A * 5/1957 Goldsholl ..... 40/653
3,452,463 A * 7/1969 Chaput ..... 40/654.01
3,879,875 A * 4/1975 Schnieder ..... 40/654.01
4,521,981 A * 6/1985 Kasprzycki et al. ..... 40/330
4,704,770 A * 11/1987 Minami et al. ..... 40/330
4,789,573 A * 12/1988 Jenkinson ..... 40/330
5,900,307 A * 5/1999 Bracikowski ..... 40/299.01
D419,289 S * 1/2000 Edwards ..... D3/208
D432,175 S * 10/2000 Finkay ..... D20/22
6,357,153 B1 * 3/2002 Gelardi et al. ..... 40/454

* cited by examiner

*Primary Examiner*—Lynne H. Browne
*Assistant Examiner*—Kenn Thompson
(74) *Attorney, Agent, or Firm*—Charles E. Baxley

(57) ABSTRACT

An identification tag includes a frame with a closed surface on a side and a peripheral flange is connected to the closed surface. A groove is defined between the closed surface and the peripheral flange. Two ventilation holes are defined through a first end of the peripheral flange and communicate with the grove. Two lugs respectively extend from an end of the closed surface and a second end of the peripheral flange. A slot is defined between the two lugs and the slot communicates with the groove so that a name card is engaged with the groove via the slot. Each of the two lugs has a hole so that a strip extends through the holes. Moisture or vapor escapes from the ventilation holes.

5 Claims, 4 Drawing Sheets

IDENTIFICATION TAG OF A SUITCASE

The application is a Continuation-In-Part application of applicant's former U.S. patent application Ser. No. 09/465,312 File date Dec. 17, 1999, abandoned.

FIELD OF THE INVENTION

BACKGROUND OF THE INVENTION

A conventional identification tag attached to a suitcase or the like is shown in FIG. 1 and generally includes a frame 10, a name card 11 retained in the frame 10 and a securing strip 12. The frame 10 has a groove 102 defined in an inside thereof so that the name card 11 is engaged with groove 102. A ring 101 is connected to an end of the frame 10 so that the strip 12 extends through the ring 101 and is tied to a suitcase. The groove 102 is defined by two sidewalls 103 which has limited length so that when the identification tag is hit or folded, the sidewalls 103 could be deformed as shown in FIG. 2 and the name card 11 could disengage from the frame 10.

U.S. Pat. Nos. 2,397,651, 4,187,628 and 2,455,236 disclosed a tag with a plate or a card received in transparent envelope. Nevertheless, the envelope disclosed in each of the above mentioned former patents has no ventilation holes for escaping the moisture or vapor trapped in the envelopes. The moisture will become vapor attached on an inside of the transparent envelope so that the card or the plate in the envelope cannot be seen clearly. Besides, the moisture could damage the card or the plate in the envelope.

The present invention intends to provide an identification tag which has a ventilation hole defined in the frame so that moisture or vapor will not trapped in the tag.

SUMMARY OF THE INVENTION

In accordance with one aspect of the present invention, there is provided an identification tag comprising a frame having a closed surface and a peripheral flange which is connected to the closed surface. A groove is defined between the closed surface and the peripheral flange. Two ventilation holes are defined through a first end of the peripheral flange and communicate with the grove. Two lugs respectively extend from an end of the closed surface and a second end of the peripheral flange. A slot is defined between the first lug and the second lug, and the slot communicates with the groove. Each of the two lugs has a hole defined therethrough so that a strip extends through the holes in the two lugs and is connected to a suitcase.

The object of the present invention is to an identification tag that has ventilation holes so as to allow moisture or vapor to escape therefrom.

These and further objects, features and advantages of the present invention will become more obvious from the following description when taken in connection with the accompanying drawings which show, for purposes of illustration only, an embodiment in accordance with the present invention.

DETAILED DESCRIPTION OF THE PREFERRED EMBODIMENT

Figure 1:
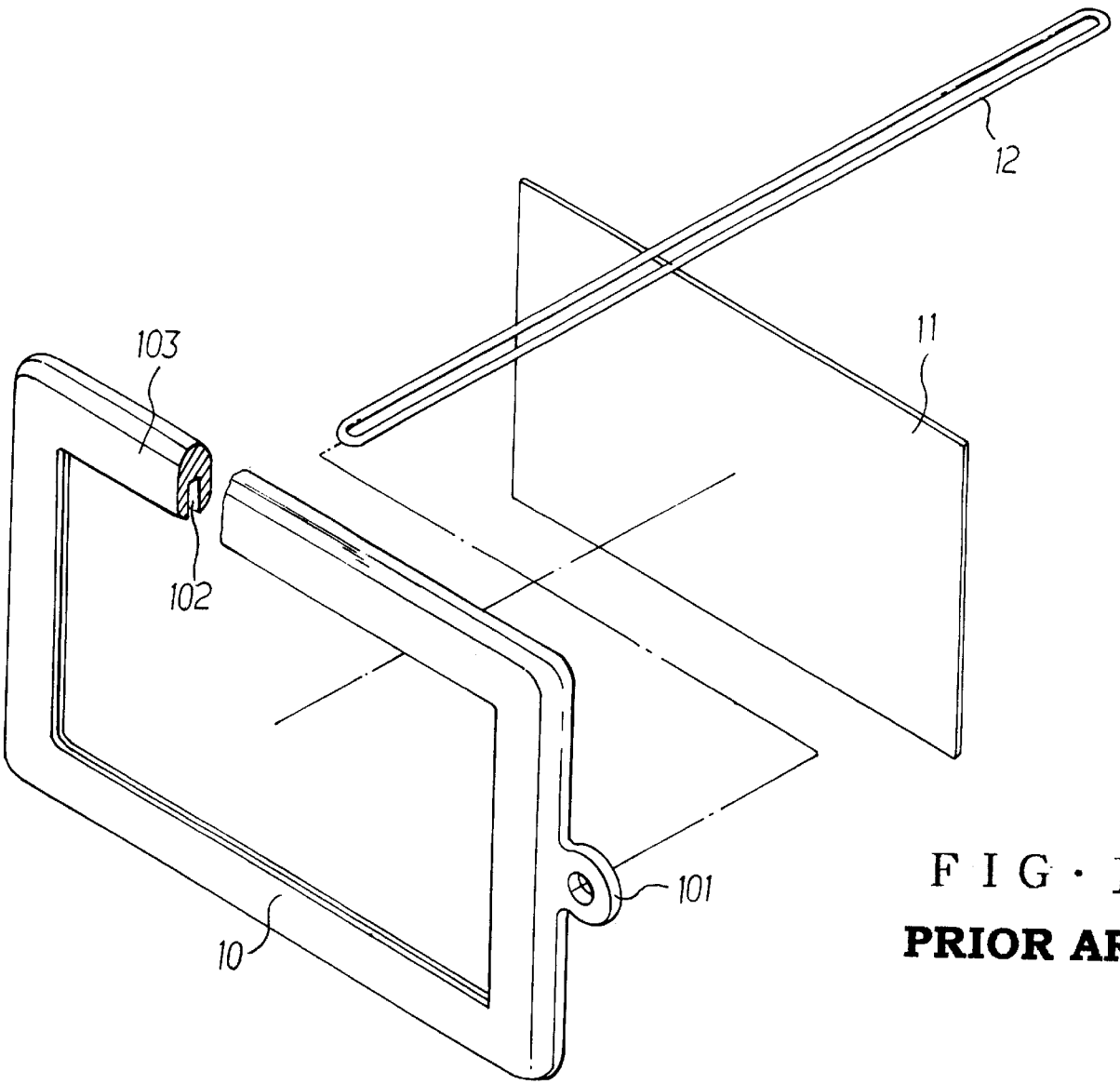
FIG. 1 PRIOR ART
FIG. 1 is an exploded view to show a conventional identification tag.
Figure 2:
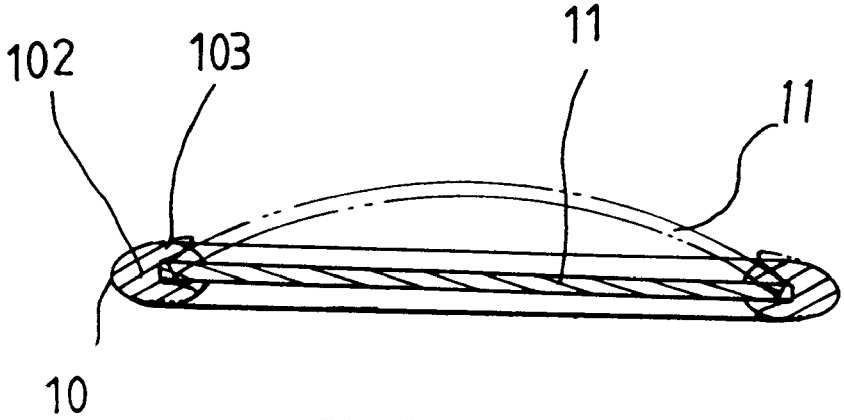
F I G · 2 PRIOR ART
FIG. 2 is an illustrative view to show when the frame of the conventional identification tag is deformed, the name card could be disengaged from the frame.
Figure 4:
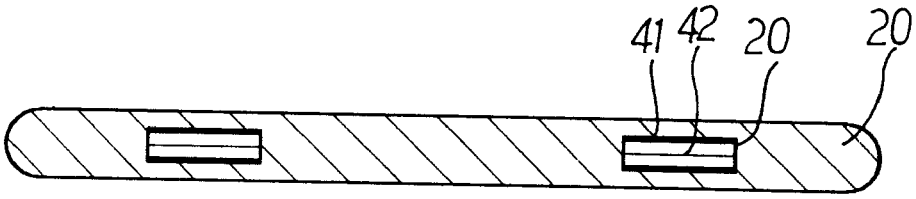
FIG. 4 is an illustrative view to show when the frame of the identification tag of the present invention is deformed, the name card is still retained in the frame.
Figure 3:
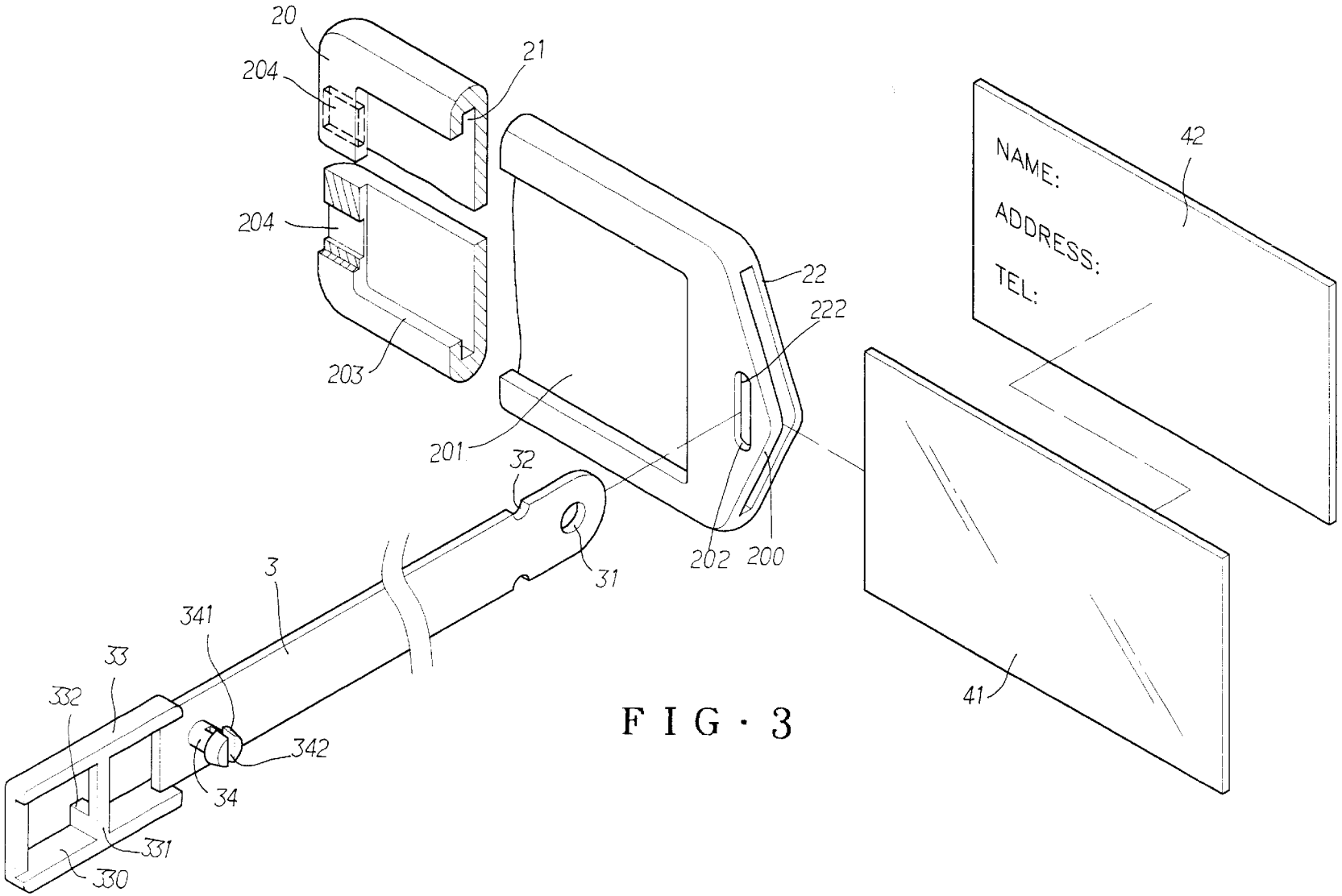
FIG. 3 is an exploded view to show an identification tag in accordance with the present invention.
Figure 5:
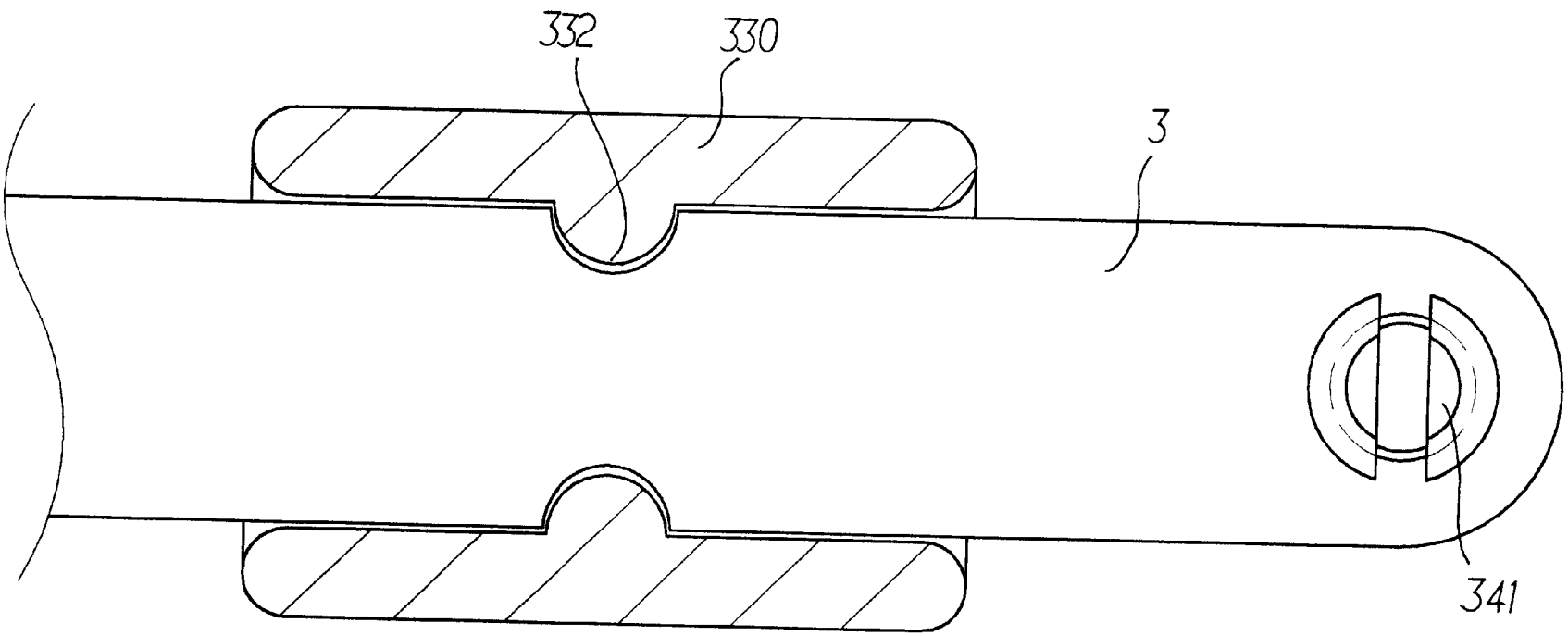
FIG. 5 is an illustrative view to show the bosses on the two flanges of the board are engaged with the two notches in the strip, wherein the retaining bar is removed for clearly showing the engagement of the bosses and the notches.

Referring to FIGS. 3 to 5, the identification tag in accordance with the present invention comprises a frame 20 having a closed surface 201 and a peripheral flange 203 connected to a periphery of the closed surface 201. A groove 21 is defined between the closed surface 201 and the peripheral flange 203. Two ventilation holes 204 are defined through a first end of the peripheral flange 203 and communicate with the grove 21. A first lug 22 extends from an end of the closed surface 201 and a second lug 200 extends from a second end of the peripheral flange 203. A slot is defined between the first lug 22 and the second lug 200 which is located in parallel with the first lug 22, wherein the slot communicates with the groove 21. Each of the first lug 22 and the second lug 200 has a hole 222/202 defined therethrough.

A name card 42 and a transparent board 41 are respectively engaged with the groove 21 via the slot so that the name and other information on the name card 42 can be seen through the transparent board 41. The name card 42 is stopped by the first end of the peripheral flange 203 and will not drop from the first end of the peripheral flange 203.

A strip 3 extends through the holes 222/202 in the first lug 22 and the second lug 200 so that the name card 42 and the transparent board 41 cannot withdrawn from the groove 21 via the slot. The strip 3 has an aperture 31 defined in a first end of the strip 3 and a board 33 is connected to a second end of the strip 3. The board 33 has two flanges 330 extending from two sides thereof and a retaining bar 331 is connected between the two flanges 330. The strip 3 has two notches 32 defined in two sides of the first end of the strip 3, and each flange 330 has a boss 332 extending from an inside thereof. The first end of the strip 3 can be extended between the board 33 and the retaining bar 331 after extending through the holes 202, 222, and the bosses 332 are engaged with the two notches 32. A locking pin 34 extends from a side of the second end of the strip 3 so that the locking pin 34 is engaged with the aperture 31 to prevent the two ends of the strip 3 from disengaging from each other. The locking pin 34 has a tapered head 341 and a slit 342 defined in the tapered head 341 so that the tapered head 341 is divided into two partitions which can be pressed together when passing through the aperture 31.

The ventilation holes 204 are located at the opposed end of the end where the strip 3 is connected. In other words, the ventilation holes 204 are located at the lower end of the tag and communicate with the slot between the two lugs so that moisture or vapor will not be trapped in the frame 20.

The closed surface 201 reinforces the structural strength of the frame 20 so that even if the frame 20 is compressed it is not deformed seriously so that the name card 42 will not disengaged from the groove 21. The engagement between the two ends of the strip 3 ensures that the strip 3 will not be loosened unintentionally. Although the frame 20 is made of flexible material, because the structural strength is improved so that it includes additional features that are not covered by conventional identification tags.

While we have shown and described various embodiments in accordance with the present invention, it should be clear to those skilled in the art that further embodiments may be made without departing from the scope of the present invention.

What is claimed is:

1. An identification tag comprising:

a frame having a closed surface and a peripheral flange which extends from said closed surface, a groove defined between said closed surface and said peripheral flange, a name card engaged with said groove, two ventilation holes defined through a first end of said peripheral flange and communicating with said groove, a first lug extending from an end of said closed surface and a second lug extending from a second end of said peripheral flange which is located in parallel with said first lug, a slot defined between said first lug and said second lug, said slot communicating with said groove, each of said first lug and said second lug has a hole defined therethrough; and a strip extending through said holes in said first lug and said second lug.

2. The identification tag as claimed in claim 1, wherein said strip has an aperture defined in a first end of said strip, a locking pin extending from a side of a second end of said strip so that said locking pin is engaged with said aperture.

3. The identification tag as claimed in claim 2, wherein said locking pin has a tapered head and a slit defined in said tapered head.

4. The identification tag as claimed in claim 2 further comprising a board on a second end of said strip and two flanges extending from two sides of said board, a retaining bar connected between said two flanges, said first end of said strip extending between said board and said retaining bar.

5. The identification tag as claimed in claim 4, wherein said strip has two notches defined in two sides of said first end of said strip, each flange having a boss extending from an inside thereof so that said bosses are engaged with said two notches.

* * * * *